US007134535B1

(12) United States Patent
Horvat

(10) Patent No.: US 7,134,535 B1
(45) Date of Patent: Nov. 14, 2006

(54) ROLLUP LUGGAGE

(76) Inventor: Daniel H. Horvat, 1636 N. Elyria Rd., Wooster, OH (US) 44691

( * ) Notice: Subject to any disclaimer, the term of this patent is extended or adjusted under 35 U.S.C. 154(b) by 161 days.

(21) Appl. No.: 10/774,669

(22) Filed: Feb. 9, 2004

Related U.S. Application Data

(60) Provisional application No. 60/446,788, filed on Feb. 10, 2003.

(51) Int. Cl.
*A45C 7/00* (2006.01)
*A45C 11/26* (2006.01)

(52) U.S. Cl. ..... 190/20; 190/107; 190/901; 206/278; 206/287; 229/87.15

(58) Field of Classification Search ..... 190/20, 190/107, 901; 220/6; 206/278, 279, 287.1, 206/293, 298; 229/87.15–87.17
See application file for complete search history.

(56) References Cited

U.S. PATENT DOCUMENTS

| | | | | | |
|---|---|---|---|---|---|
| 113,734 | A * | 4/1871 | Brockway | 190/115 |
| 202,850 | A * | 4/1878 | McKinnon | 150/109 |
| 296,993 | A * | 4/1884 | Moffly | 206/454 |
| 503,355 | A * | 8/1893 | Phillips | 206/278 |
| 1,159,743 | A * | 11/1915 | Buxton | 206/278 |
| 1,163,683 | A * | 12/1915 | Osgood | 206/278 |
| 2,296,080 | A * | 9/1942 | Arrowood | 206/298 |
| 2,319,497 | A * | 5/1943 | Franklin | 190/16 |
| 2,423,297 | A * | 7/1947 | Creamer | 206/279 |
| 2,502,033 | A * | 3/1950 | Bohn | 206/293 |
| 3,621,991 | A * | 11/1971 | Richter | 206/284 |
| 5,060,795 | A * | 10/1991 | Bomes et al. | 206/279 |
| 5,469,967 | A * | 11/1995 | Boorady | 206/527 |
| 5,624,026 | A * | 4/1997 | Chernoff | 206/289 |
| 6,039,474 | A * | 3/2000 | DeChant | 383/66 |
| 6,513,692 | B1 * | 2/2003 | Forgosh et al. | 224/575 |
| 6,668,990 | B1 * | 12/2003 | Humiston, Jr. | 190/109 |

* cited by examiner

*Primary Examiner*—Sue A. Weaver
(74) *Attorney, Agent, or Firm*—Jerry Semer

(57) ABSTRACT

This invention is a bag that opens down the center of its length and when filled, easily rolls up into a small package. The topside of the bag comprises two flaps that extend along the whole length of the bag and when these flaps are open, the entire inside of the bag is exposed. Once the items are packed, the flaps are pulled back over the items, and closure is obtained by zipper. At the bottom of the bag is a cylindrical accessory case. This cylindrical bag also provides an excellent cylindrical object to roll the bag around. On both sides of the bag are flaps that are designed such that when the bag is rolled, these flaps will cover the outside ends of the bag and protect the bag.

9 Claims, 12 Drawing Sheets

ROLLUP LUGGAGE

This application is a continuation-in-part of Application Ser. No. 60/446,788 filed Feb. 10, 2003.

FIELD OF THE INVENTION

This invention relates to the field of luggage and more particularly to luggage that rolls up.

BACKGROUND OF THE INVENTION

One of the big hassles with most luggage is that it is too deep. Thus, an individual has to place one set of items he is packing on top of another. Sometimes the items must be packed three or four items deep. Therefore, to get an item, one would have to dig out two or three other items before one got the item he wanted. Then, if one wishes for a well-organized suitcase, one must put the other items back in place. However, this usually does not happen and the suitcase becomes disordered quickly. This is especially true for bags that are much deeper than they are wide. These are bags such as saddlebags for motorcycles or bicycles, or a backpack for campers and hikers. In this case, an individual may have to take out several items before he finds the one he wants then those items have to be replaced in order that is nearly impossible. Thus, saddlebags or packs become disorganized quickly. Therefore, one of the objectives of this invention is to create a piece of luggage that is much wider and longer than it is deep. Another objective of this invention is to create a piece of luggage that will be easy to keep organized throughout an entire trip.

Another objective of the invention is to create a piece of luggage that can be easily organized at the start. One wants a piece of luggage that items placed within that luggage, such as your socks, shirts, and underwear need only be stacked one or two items deep. This allows an individual to easily pack the suitcase since he can see almost every group of items placed within by just opening up the suitcase. Further, as pointed out above, this eliminates the problems when you are on a trip of having to dig through the suitcase to find an item.

Another objective of the invention is to create a piece of luggage that is easy to pack and easy to close. Further, the piece of luggage needs to be inexpensive and easy to manufacture.

The feature that makes this invention achieve the above objectives is that the luggage is a long bag that can be opened in its center along the entire length and then when closed can be rolled up into a small package.

The inventor has designed this invention to be used by motorcyclists, bicyclists, outdoorsman, and pedestrians. The bag due to its compactness would be ideal for soldiers. Thus, one of his objectives was to pack a large amount of material in a small, compact area. Further, the luggage has been designed so that it will easily fit upon a bicycle or motorcycle.

SUMMARY OF THE INVENTION

This invention is a long bag that opens down the center of its length and when filled, easily rolls up into a small package. The topside of the bag comprises two flaps that extend along the whole length of the bag and when these flaps are open, the entire inside of the bag is exposed. Thus, the individual can lie out the items he wishes in the bag and can see all the items clearly. Once the items are packed, the flaps are pulled back over the items, and closure is obtained by zipper, Velcro, snaps, or other means known in the art. At the bottom of the bag is a semi-rigid, cylindrical accessory case. This accessory case allows an individual to place his toiletry items and segregate them from the rest of his clothing. This cylindrical, semi-rigid bag also provides an excellent cylindrical object to roll the bag around. On both sides of the bag are flaps that are designed such that when the bag is rolled, these flaps will cover the outside ends of the bag and protect the bag. These flaps also are used to hold the bag in a compact roll. Once the bag is rolled, belts attached to the back of the bag are tightened around the roll to hold it in place.

DETAILED DESCRIPTION OF THE PREFERRED EMBODIMENT

Figure 1:
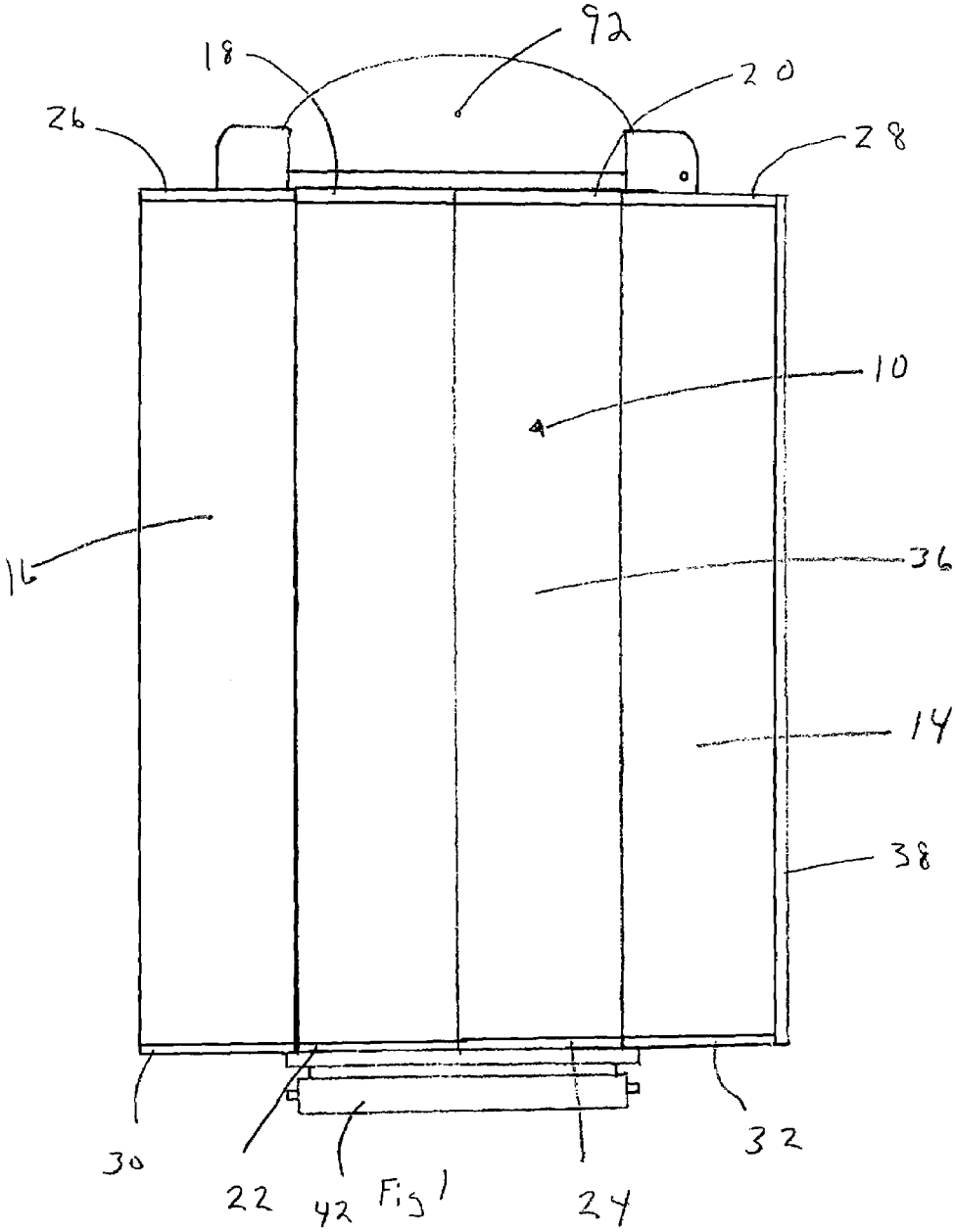
FIG. 1 is a top view the invention unrolled and opened.
Figure 2:
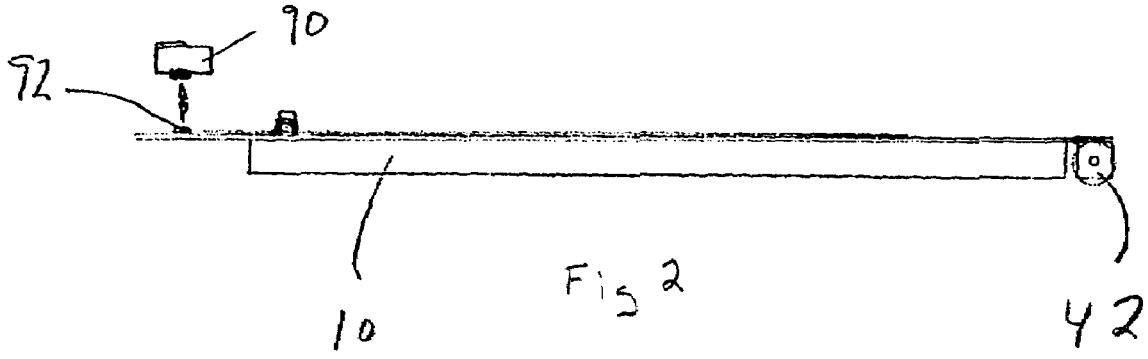
FIG. 2 is a side view of the invention.

FIG. 1 shows the bag 10 unrolled and opened. In FIG. 1, one can see the interior 36 of bag 10 and closure flaps 14 and 16. An individual packs his clothes in the interior 36 of bag 10. FIG. 2 shows the side view of the bag 10. In the preferred embodiment, the interior 36 of bag 10 is forty-four inches long, twenty inches wide, and three inches high. One, however, can make this bag to different proportions to suit different needs. However, the bag will always be much longer and wider than its depth as shown in FIG. 2. This allows an individual to lay out his clothes within the bag 10 with differing areas for his underwear, socks, pants, and shirts. In the usual case, these areas will only be one item thick and thus, when an individual wishes to retrieve the items from the bag 10, he can just take them out of the area without disturbing the other contents and thus, keeping the bag 10 well organized.

Figure 3:
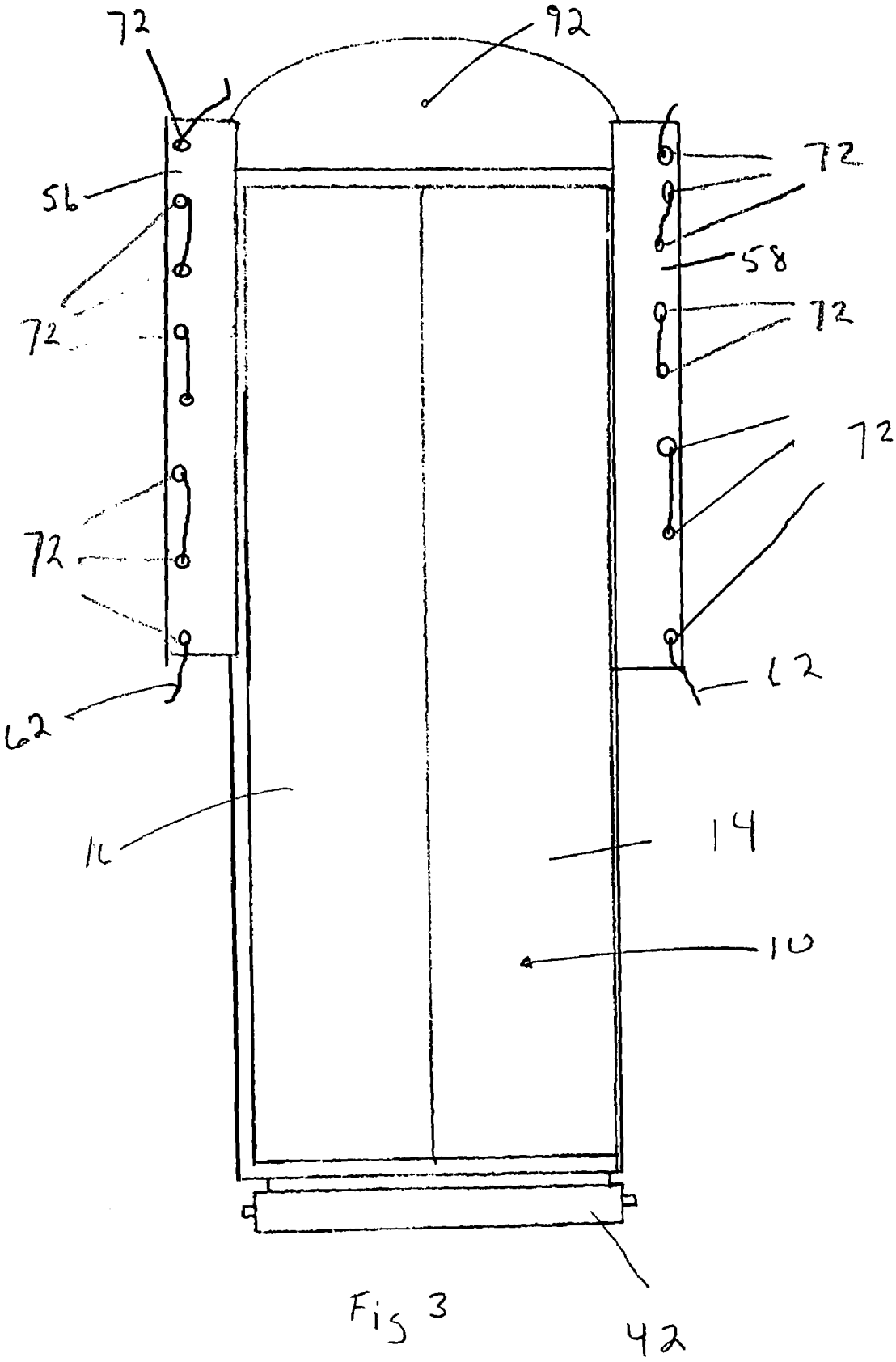
FIG. 3 is a top view the invention unrolled.

FIG. 1 shows strips 18 and 20 of hook and loop fabric known as Velcro running along the top of the interior 36 of the bag 10 and hook and loop strips 22 and 24 on the bottom of the interior 36 of the bag 10. Strips 26 and 28 of hook and loop fabric also run along the top of closure flaps 14 and 16 and strips 30 and 32 of hook and loop fabric run along the bottom of closure flaps 14 and 16. When the bag is closed, as shown in FIG. 3, the hook and loop fabric strips 26, 28, 30 and 32 running along the top and bottom of closure flaps 14 and 16 attached to the hook and loop fabric strips 18, 20, 22 and 24 that run along the top and bottom of the opening 36, in bag 10. This provides for a secure closing.

Figure 4:
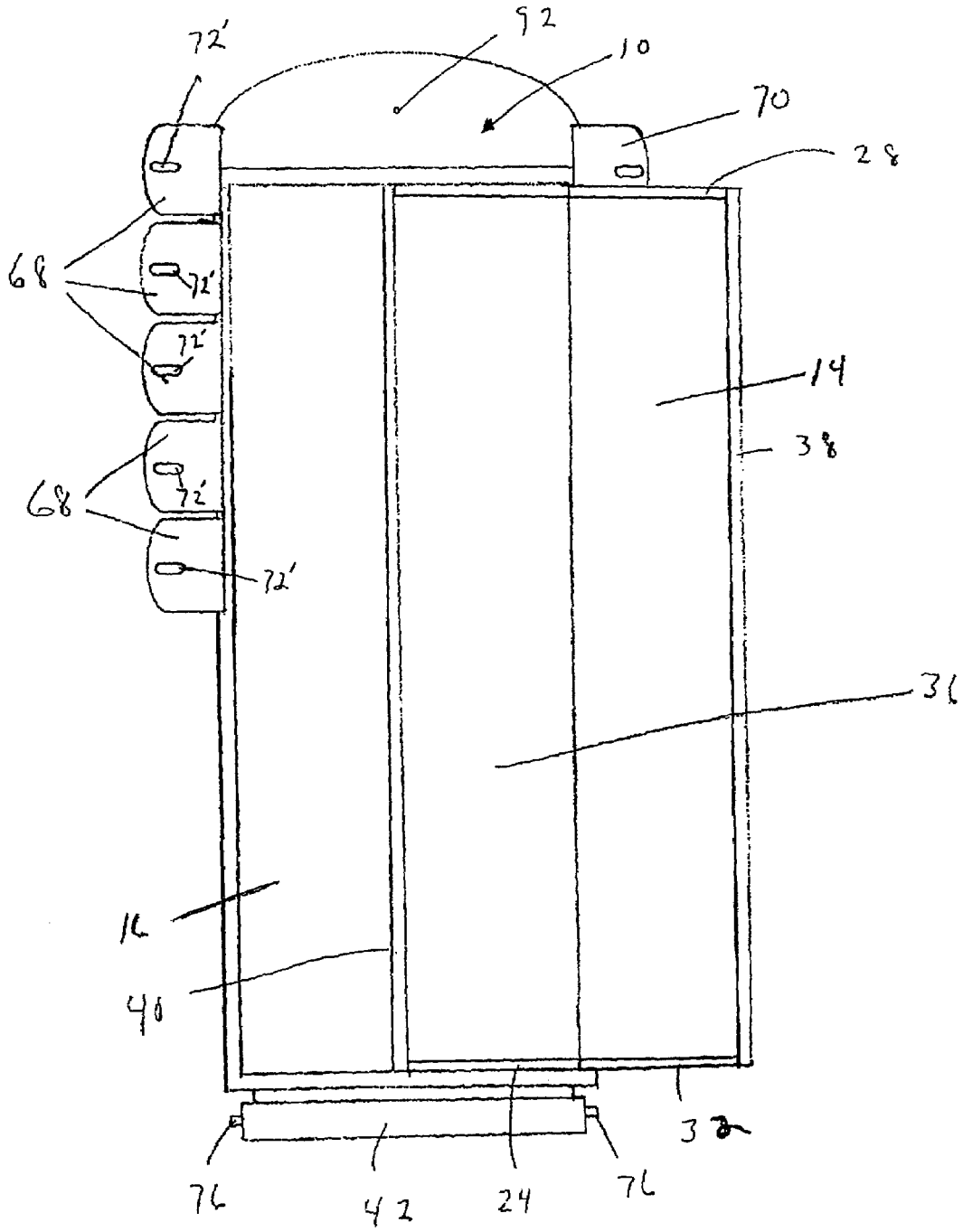
FIG. 4 is a top view the invention unrolled and with one side opened and with saw tooth flaps.

Also, FIG. 1 shows a strip 38 of hook and loop fabric running along the outer edge of closure flap 14. FIG. 4 shows the bag 10 with closure flap 16 closed. Along the outer edge of closure flap 16, there is another strip 40 of hook and loop fabric. When the bag is fully closed as in FIG. 3, strip 38 of hook and loop fabric on closure flap 14 attached to hook and loop fabric strip 40 on closure flap 16 thoroughly sealing the interior 36 of bag 10. Zippers, snaps, and other means known in the art could be used to close flaps 14 and 16 of bag 10.

Figure 11:
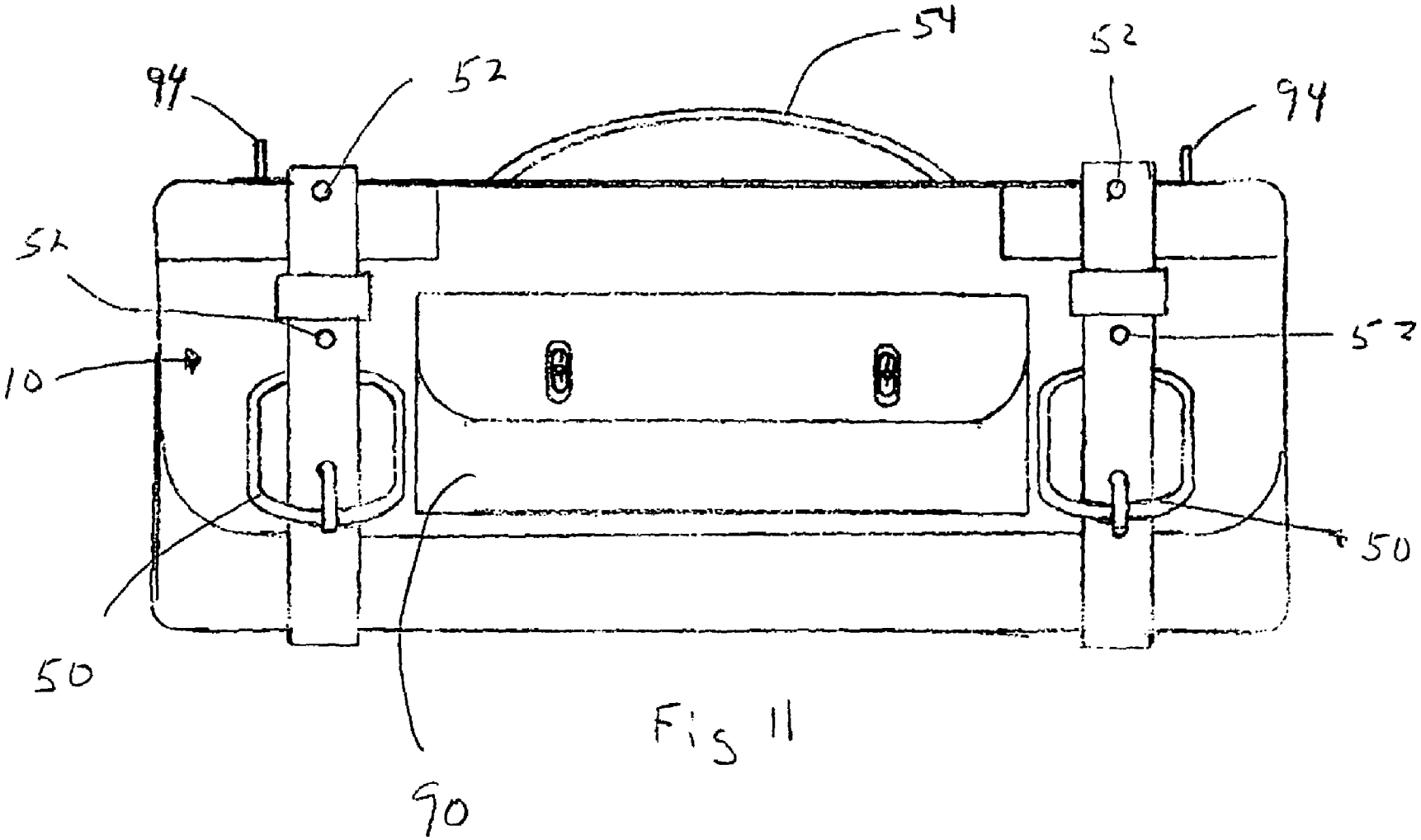
FIG. 11 is a top view of the invention rolled up with the clip on bag attached.

FIG. 2 shows a clip on bag 90 being attached to the bag 10. FIG. 11 show the bag rolled up with the clip on bag 90 attached. Hookup bag 90 is attached via opening 92 shown in FIGS. 1 and 6. The bag can be attached or removed. When bag 10 is rolled hookup bag 90 remains on the outside of bag 10 and can still be opened as shown in FIG. 11.

Figure 5:
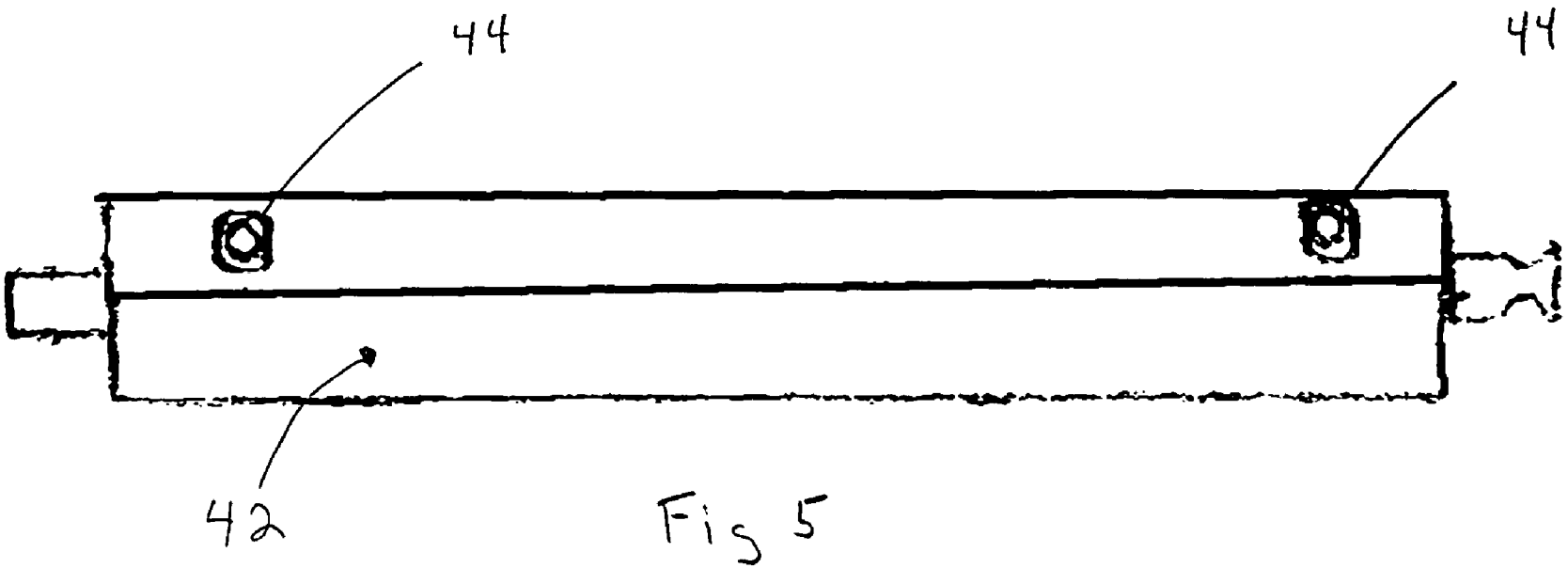
FIG. 5 is a view of the cylindrical bag.

At the bottom of bag 10 there is a cylindrical bag 42. This cylindrical bag 42 is shown in FIG. 5. Cylindrical bag 42 is made out of a rigid or semi-rigid material such as leather. In the preferred embodiment, the cylindrical bag 42 is approximately the width of the bag 10 and approximately three inches in diameter. This cylindrical bag 42, however, can be made in other dimensions and does not necessarily need to be cylindrical. The inventor has used a cylindrical bag 42 because this cylindrical bag 42 is used to start the rolling of the bag and cylindrical bags work better. However, the bag could actually be square and still achieve its purpose. In FIG. 5, cylindrical bag 42 has a closing member 44. In the preferred embodiment, the closing members 44 are snaps. However, there are several methods to close this cylindrical bag 42 such as Velcro, straps and buckles, snaps, zippers, buttons, and other methods known in the art.

Figure 6:
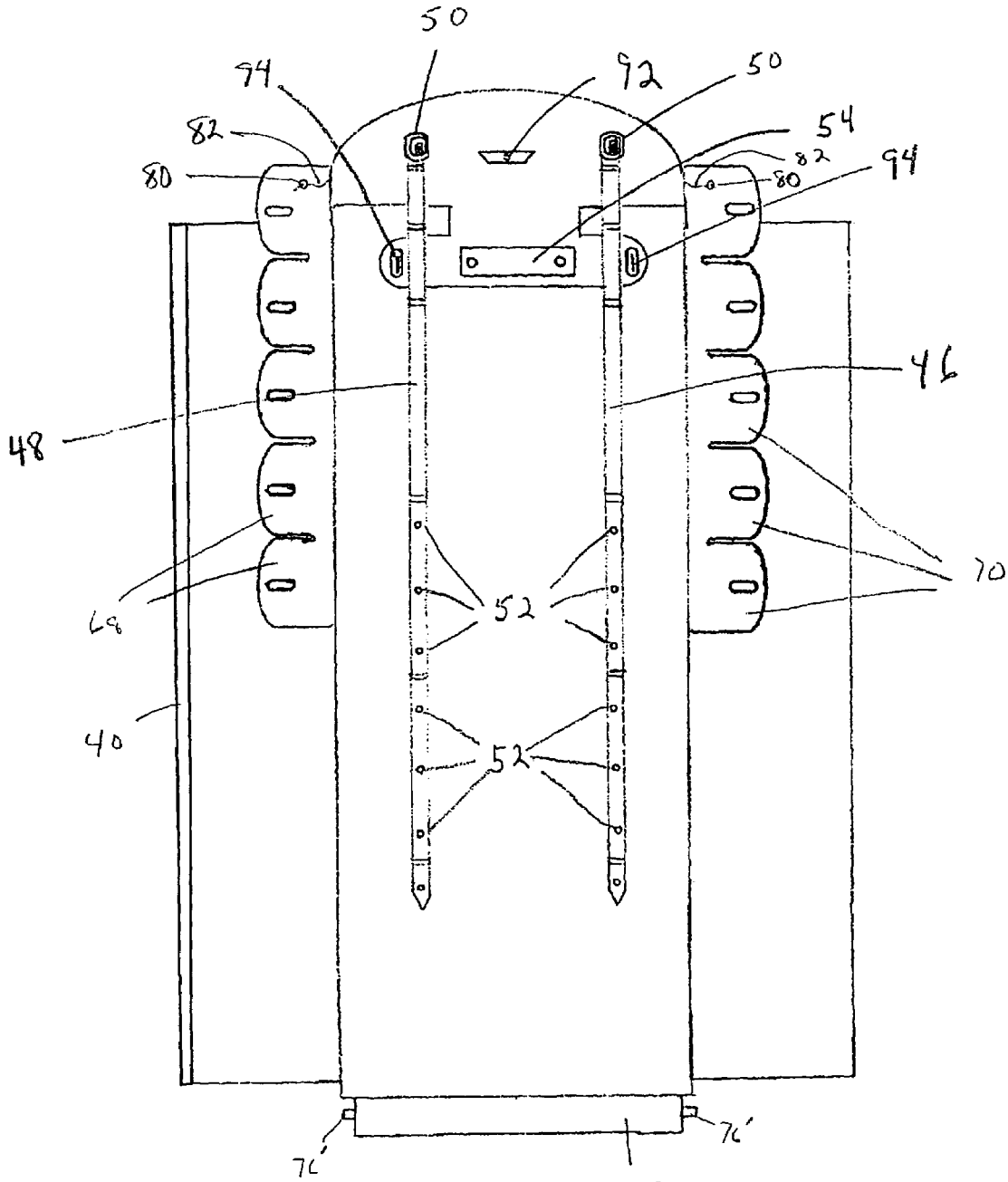
FIG. 6 is a back view of the invention with saw tooth flaps.
Figure 7:
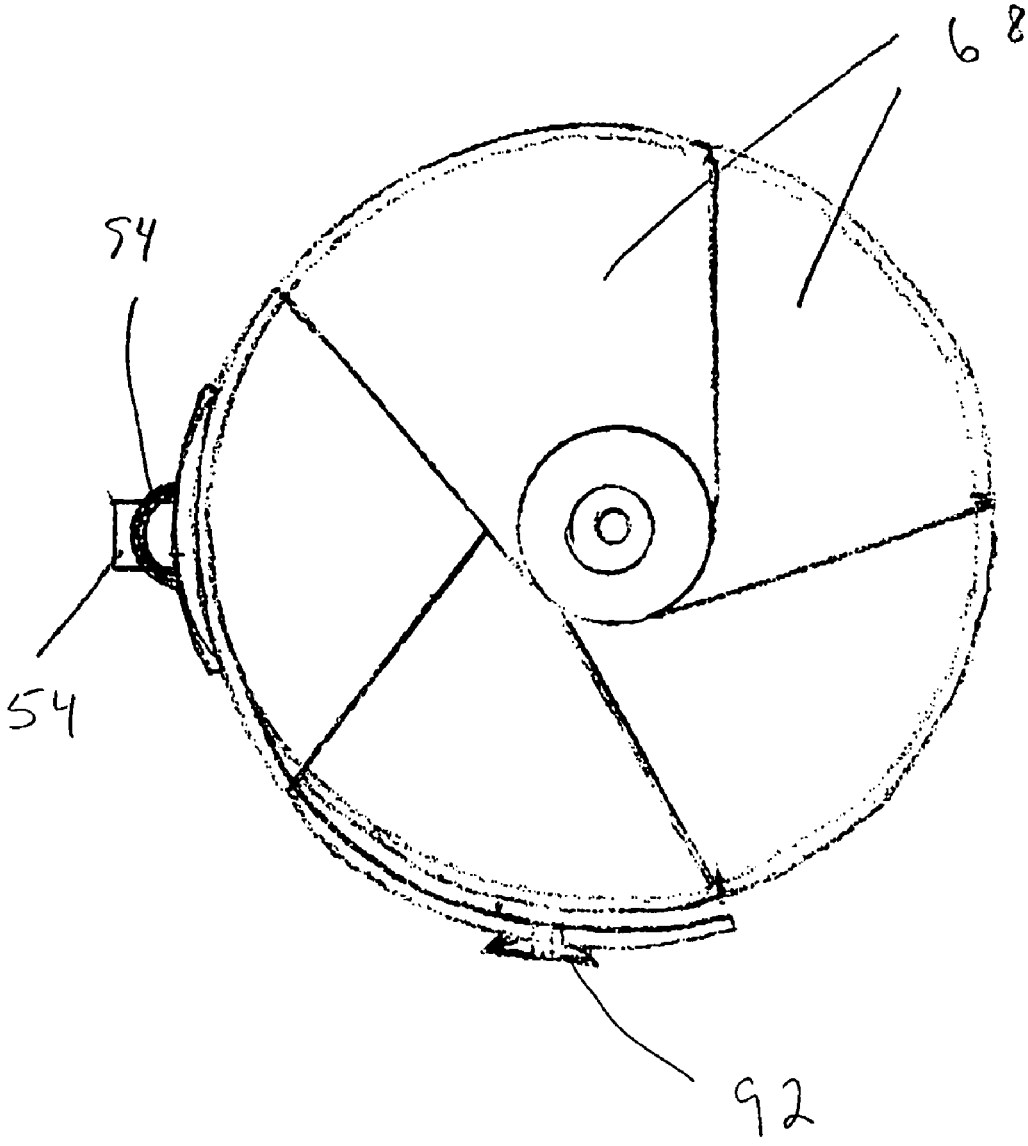
FIG. 7 is an end view the invention rolled up.

FIG. 6 is a back view of the bag 10. In FIG. 6, one can see two belts 46 and 48 that are attached to the back of the bag 10. These belts 46 and 48 have buckles 50 and openings for the buckles 52. The belts are attached to the back of the bag near the top. When the bag 10 is rolled up, the ends of the belts 46 and 48 with the openings 52 are stuck through buckles 50 and pulled tight and buckled to hold the bag 10 in a tight roll as shown in FIG. 11. The rolled up bag 10 with the buckles 50 buckled is shown in FIGS. 5, 7 and 11. In addition, FIGS. 6 and 11 shows that attached to the back of the bag 10 is a handle 54. This handle 54 can be used to carry the bag when it is rolled up as in FIG. 11. FIGS. 6 and 11 also shows two D rings 94 attach to bag 10 on opposite sides of the handle. To these D rings 94 one can be attached a carrying strap so that the bag can be carried over the shoulder.

FIG. 3 show that the bag 10 has outer flaps 56 and 58 on each of its sides. Along the edge of these outer flaps 56 and 58 are grommets 72. Through these grommets 72 is run a rope 62. When the bag 10 is rolled up, as shown in FIG. 7, the rope 62 is pulled tight through the grommets 72 and tied and thus closes the side of the bag.

Figure 8:
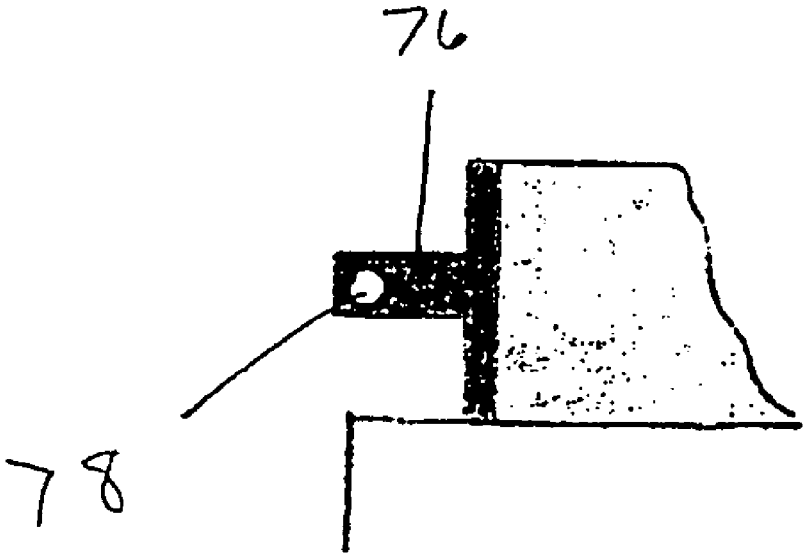
FIG. 8 is a view of the spring pin and the pin with in the end of the cylindrical bag.
Figure 8:
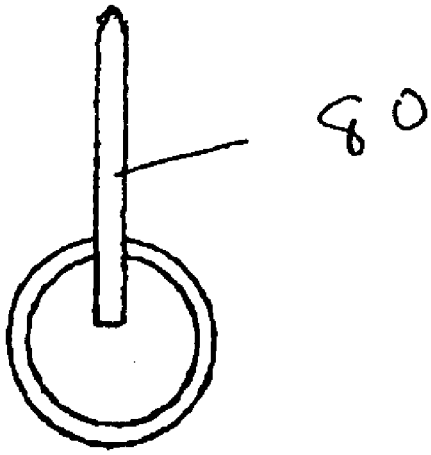
Figure 10:
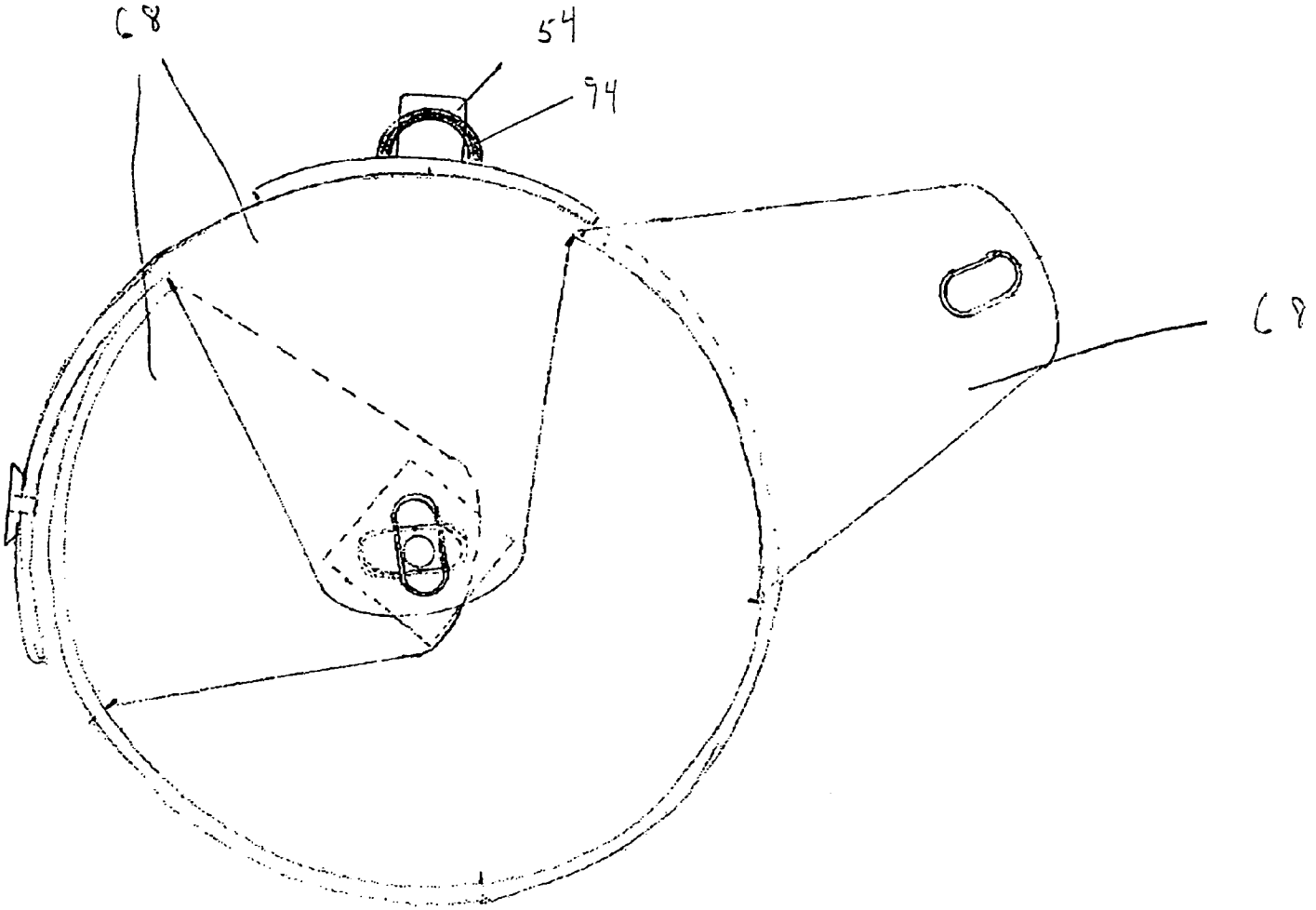
FIG. 10 is an end view of the invention rolled up with oval grommets.

FIG. 4 shows bag 10 with different outer flaps 68 and 70 and a different side closure means. In this embodiment, bag 10 also has two outer flaps 68 and 70. These outer flaps 68 and 70 have a saw tooth like design. In addition, along the edge of the saw tooth, there are grommets 72' and these grommets 72' in the preferred embodiment have an oval shape opening. At each end of the cylindrical bag 42 is a pin 76 with opening 78 as shown in FIG. 8. FIG. 10 shows the rolled up end view of bag 10 of the second embodiment. In this rolled up end view, one can see that the grommets 72' of the saw toothed outer flaps 68 and 70 are placed over the pin 76 on the cylindrical bag 42 once the bag 10 is rolled up. FIG. 6 shows that attached to the top, on each side of the bag 10 by a string 82 is a spring pin 80. This spring pin 80 is placed through the opening 78 in pin 76. When the spring pin 80 goes through opening 78, it expands slightly, thus, securely holding the spring pin 80 in place and also holding the saw toothed grommets 72' of the saw toothed outer flaps 68 and thus covering the end of the bag as shown in FIG. 7.

Figure 9:
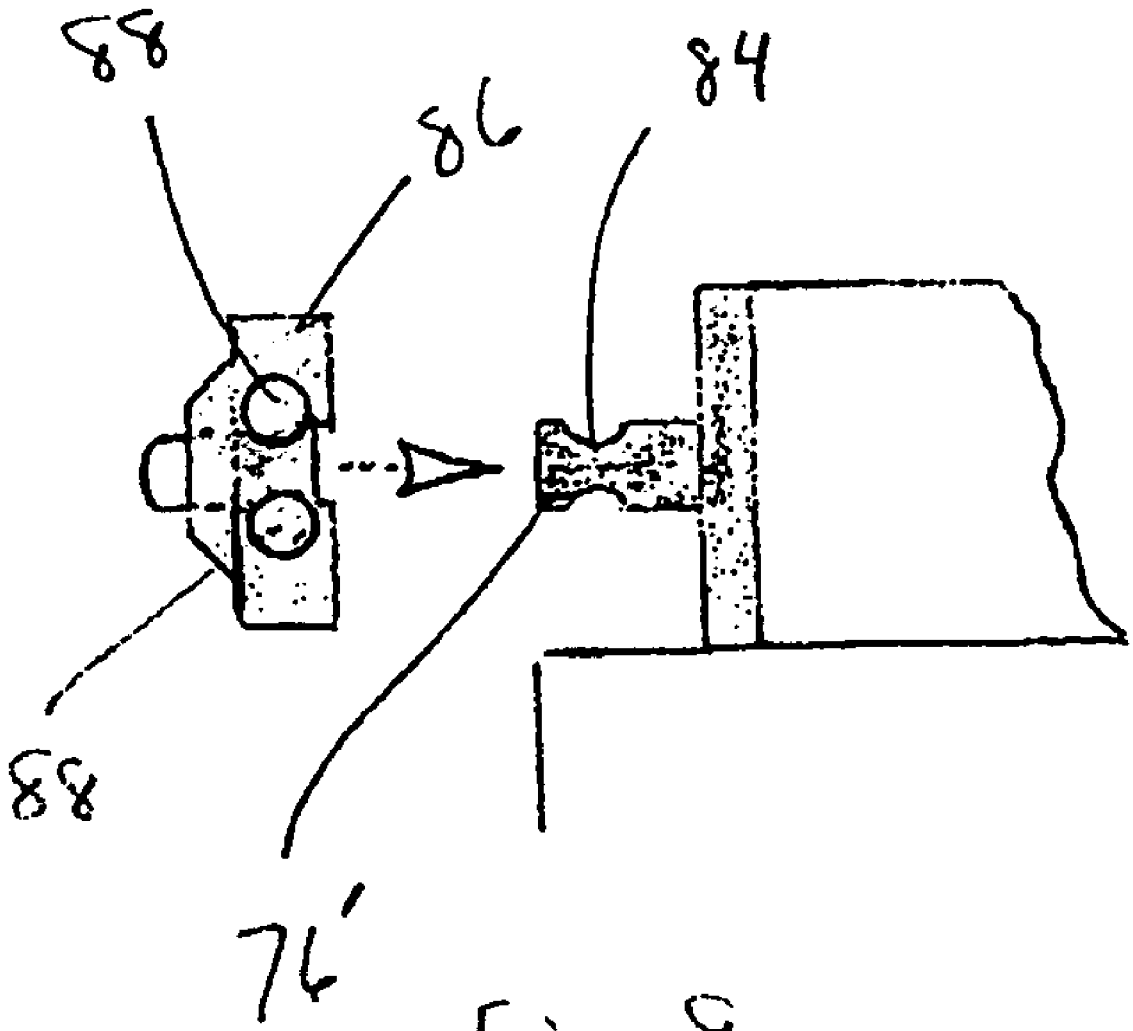
FIG. 9 is a view of the spring ball bearing snap and the pin with groove in the end of the cylindrical bag.

FIG. 9 shows another method or design for attaching the saw tooth outer flaps 68 in place when the bag is rolled up. The only difference in this embodiment the pin 76 on the cylindrical bag 42 has a groove 84 near its top. FIG. 9 is a cut away view of a spring ball baring snap 86. This spring ball baring snap 86 is circular in shape with an opening of sufficient size to fit over pin 76. As shown in FIG. 7 the grommets 72 of the saw toothed outer flaps 68 are placed over pin 76 and then the spring hall baring snap 86 is placed on pin 80. FIG. 9 shows ball bearings 88 within the spring ball bearing snap 86. These ball bearings are spring loaded. Thus when the spring ball baring snap 86 is placed over pin 76 the ball bearings 88 are pressed apart and when they come to the groove 84 in pin 80 they snap back into place securely holding the saw tooth outer flaps 68 in place.

Figure 12:
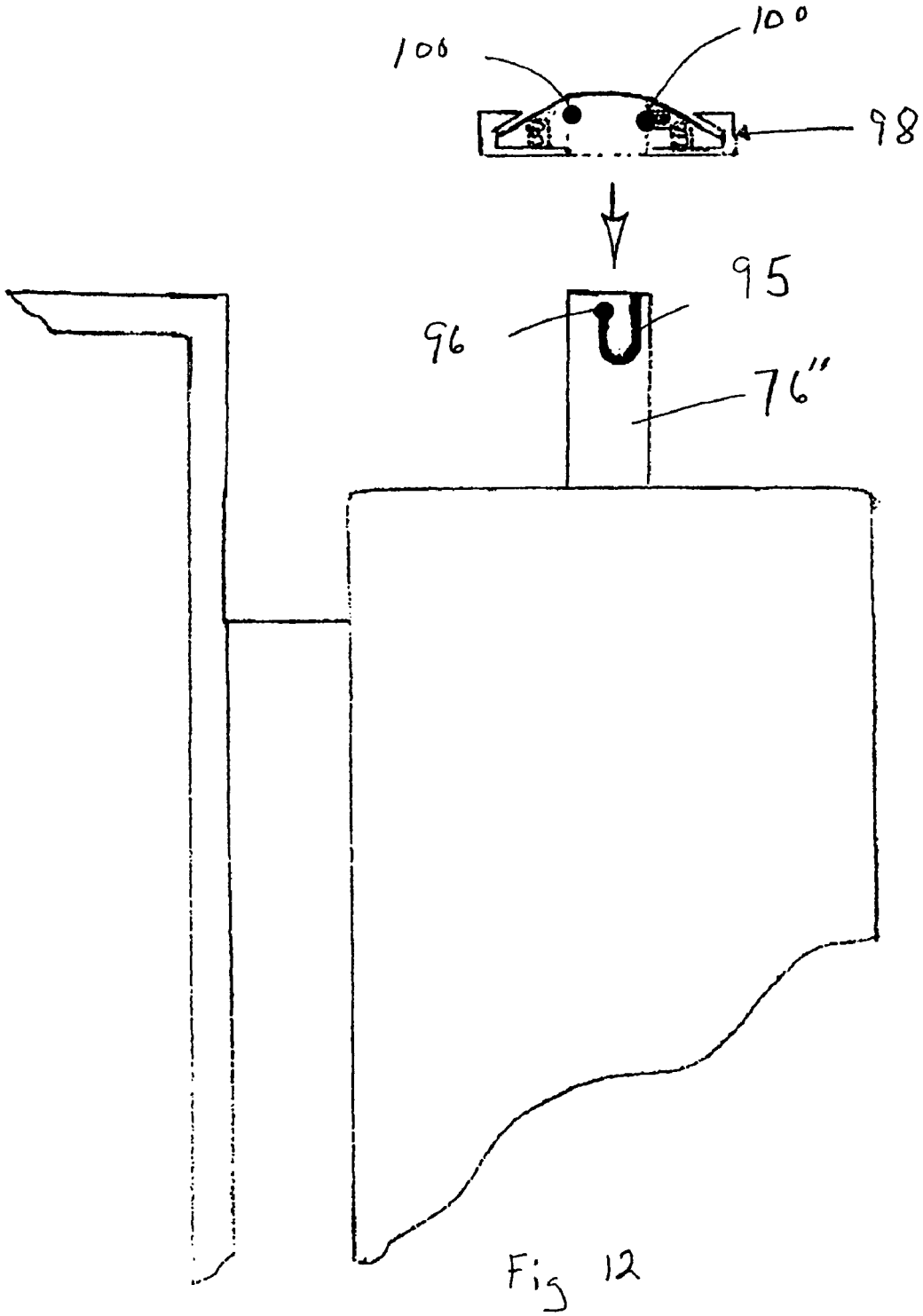
FIG. 12 is a view of the ball bearing twist snap and the pin with a J groove in the end of the cylindrical bag.

FIG. 12 shows another method or design for hold the outer flaps 68 in place when the bag is rolled up. The only difference in this embodiment and the previous embodiment is pin 76" of cylindrical bag 42 has a J groove 95 extending from the top of pin 76". This J groove 95 is slightly deeper in its indented end 96 than the rest of the groove. In FIG. 9 also shows a cutaway view of the ball bearing twist snap 98. The pin 76" has the J groove 95 on each side. When the spring ball bearing twist snap 98 is placed over pin 76', the ball bearings 100 aligns with the top of the J groove 95. The spring ball bearing twist snap 98 is then pushed down through the J groove 95 and slightly twisted and then the ball bearings 100 snap into place in the indented end 96 of the J groove 95. The ball bearings 100 are spring loaded so that when they snap into the indented end of the groove 96, they will securely hold the flaps 68 in place.

The invention claimed is:

1. Rollup luggage comprising:

a. a piece of fabric with a front and a back and having two sides, a top and a bottom; and, b. a first flap with four edges in which one of the first flap's edges attaches to one of the sides of the piece of fabric and the two opposing edges of the first flap releasably attached to the piece of fabric; and, c. a second flap with four edges in which one of the second flap's edges attaches to one of the sides of the piece of fabric, and the two opposing edges of the first flap releasably attach to the piece of fabric and the other edge of the second flap releasably attaches to an edge of the first flap and when all edges of the first and second flaps are attached an enclosed bag is formed which can be packed with clothing and other articles and rolled up; and, d. a container with two ends attached to the bottom of the piece of material and said bag can be rolled up around said container; and, e. two saw tooth flaps attached to opposing sides of the piece of fabric and extend outward from the piece of fabric and said saw tooth flaps have a saw tooth shape; and, f. a set of openings on the outer edge of the saw tooth flaps; and, g. a pin attached to both ends of the container and when the bag is rolled up the openings in the saw tooth flaps fit over the pins: and, h. a means for holding the saw tooth flaps on the pin securely when the bag is rolled up; and i. whereas when the bag is rolled up and the openings in the saw tooth flaps are placed over the pins attach to the container and the means for holding the saw tooth flaps on the pins securely is engaged thus closing the sides of the bag.

2. Rollup luggage as in claim 1 wherein:

a. the container is cylindrical.

3. Rollup luggage as in claim 1 further comprising:

a. the pins have a J groove attached to both ends of the container and, b. the means for holding the saw tooth flaps on the pin securely is two spring ball baring twist snaps that when place over the pins and twisted will snap into place;

c. whereas when the bag is rolled up and the openings in the saw tooth flaps are placed over the pins attach to the container and the spring ball baring twist snaps are placed over the pins and when twisted, the twisted snaps snap into place holding the flaps in place and closing the sides of the bag.

4. Rollup luggage as in claim 1 wherein:

a. the container is made of ridged material.

5. Rollup luggage as in claim 1 wherein:

a. when the two flaps are extended outward from the side of the piece of fabric the whole interior of the bag can be seen.

6. Rollup luggage as in claim 1 wherein:

a. a belt with two ends and one end has a buckle and the other end has openings for the buckle attached to the back of the piece of material and when the bag is rolled up, the ends of the belt with the openings is stuck through buckle and pulled tight and buckled to hold the bag in a tight roll.

7. Rollup luggage as in claim 1 further comprising:

a. the pins have an opening and, b. the means for holding the saw tooth flaps on the pin securely is two spring pins whose ends can expand;

c. whereas when the bag is rolled up the openings in the saw tooth flaps are placed over the pins attach to the container and the spring pins are place through the opening in the pins and the ends of the spring pins expand holding the saw tooth flaps in place and closing the sides of the bag.

8. Rollup luggage as in claim 1 further comprising:

a. each pin has a groove and, b. the means for holding the saw tooth flaps on the pins securely is two spring loaded snaps that when place over the pins will snap into the grooves;

c. whereas when the bag is rolled up and the openings in the saw tooth flaps are placed over the pins attach to the container and the spring loaded snaps are placed over the pins and snap into the groove holding the saw tooth flaps in place and closing the sides of the bag.

9. Rollup luggage as in claim 1 further comprising:

a. a handle attached to the back of the piece of fabric that can be used to carry the bag when the bag is rolled up.

* * * * *